US009756964B2

(12) United States Patent
Yang

(10) Patent No.: US 9,756,964 B2
(45) Date of Patent: Sep. 12, 2017

(54) FOLDABLE ENCLOSURE APPARATUS FOR A BABY BED

(71) Applicants: Shu-Chen Wang, Zhongshan, GuangDong (CN); SUNNYLOVE BABY PRODUCTS ZHUHAI CO., LTD., Zhuhai, Guangdong (CN)

(72) Inventor: Cheng-Fan Yang, Tainan (TW)

(73) Assignees: Shu-Chen Wang, Zhongshan (CN); SUNNYLOVE BABY PRODUCTS ZHUHAI CO., LTD., Zhuhai, Guangdon (CN)

( * ) Notice: Subject to any disclaimer, the term of this patent is extended or adjusted under 35 U.S.C. 154(b) by 0 days.

(21) Appl. No.: 14/997,967

(22) Filed: Jan. 18, 2016

(65) Prior Publication Data

US 2016/0338506 A1 Nov. 24, 2016

(30) Foreign Application Priority Data

May 20, 2015 (CN) ..... 2015 1 0261139

(51) Int. Cl.
*A47D 9/00* (2006.01)
*A47D 13/06* (2006.01)

(52) U.S. Cl.
CPC ..... *A47D 9/005* (2013.01); *A47D 13/063* (2013.01)

(58) Field of Classification Search
CPC . A47D 7/00; A47D 7/002; A47D 7/01; A47D 7/04; A47D 9/00; A47D 9/005; A47D 13/063; A47D 13/065; A47D 13/066; A47D 13/068; A47D 13/06; A47D 13/061; Y10T 403/32409; Y10T 403/32278; Y10T 403/18768; Y10T 403/1877; Y10T 74/18768; Y10T 74/1877
See application file for complete search history.

(56) References Cited

U.S. PATENT DOCUMENTS 5,241,716 A * 9/1993 Kohus ..... A47D 13/063 16/354
6,438,773 B1 * 8/2002 Hsia ..... A47D 7/002 5/98.1
6,485,216 B1 * 11/2002 Cheng ..... B62B 7/06 280/47.36
6,488,435 B1 * 12/2002 Janson ..... B64G 1/222 136/245
6,665,895 B1 * 12/2003 St. Pierre ..... A47D 13/063 403/102

(Continued)

*Primary Examiner* — Eric Kurilla
(74) *Attorney, Agent, or Firm* — Pai Patent & Trademark Law Firm; Chao-Chang David Pai

(57) ABSTRACT

A foldable enclosure apparatus for a baby bed has a hub device, a supporting assembly and four linking devices. The hub device has four racks. The supporting assembly is disposed around the hub device. Each linking device is connected with the hub device and the supporting assembly. Each linking device has a first linking assembly and a second linking assembly. The hub device is pulled and the racks are moved upwardly. The first linking assemblies and the supporting assembly are moved toward the hub device. The installment of the first linking assemblies and the second linking assemblies has the effects of linkage and balance. Therefore, the foldable enclosure apparatus for a baby bed can be easily, smoothly and steadily folded and spread.

17 Claims, 18 Drawing Sheets

(56) References Cited

U.S. PATENT DOCUMENTS

| | | | | |
|---|---|---|---|---|
| 2003/0061657 | A1* | 4/2003 | Longenecker | A47D 13/063 5/99.1 |
| 2006/0185082 | A1* | 8/2006 | Casati Troutman | A47D 13/063 5/99.1 |
| 2006/0288809 | A1* | 12/2006 | Fleytman | F16H 19/04 74/89.11 |
| 2007/0017025 | A1* | 1/2007 | Myer | A47D 13/063 5/99.1 |
| 2008/0189854 | A1* | 8/2008 | Thorne | A47D 13/063 5/99.1 |
| 2009/0320205 | A1* | 12/2009 | Chen | A47D 13/063 5/99.1 |
| 2010/0162484 | A1* | 7/2010 | Thomas | A47D 5/00 5/93.2 |
| 2015/0001455 | A1* | 1/2015 | Chen | A47D 13/066 256/25 |
| 2015/0272343 | A1* | 10/2015 | Hung | A47D 13/061 5/99.1 |

* cited by examiner

FOLDABLE ENCLOSURE APPARATUS FOR A BABY BED

BACKGROUND OF THE INVENTION

1. Field of the Invention

The present invention relates to a foldable enclosure apparatus for a baby bed, and more particularly to a foldable enclosure apparatus that can be easily, smoothly and steadily folded and spread.

2. Description of Related Art

A conventional foldable enclosure apparatus for a baby bed has a lower supporting assembly, a side supporting assembly, and an upper supporting assembly. The lower supporting assembly has a hub member and four lower members. The hub member has a fixing seat and a moving seat. The moving seat is moveably mounted in the fixing seat of the hub member. The lower members are pivotally mounted on the hub member. Each lower member has a top rod and a bottom rod. The top rod of the lower member is pivotally mounted on the fixing seat and an end of the top rod is connected to the moving seat. The bottom rod of the lower member is pivotally mounted on the fixing seat.

The side supporting assembly is rotatably mounted on the lower supporting assembly and has four side members connected to the lower members respectively. Each side member has a side rod, a first connecting seat, a second connecting seat, and a linking portion. The side rod is hollow. The first connecting seat is mounted on a bottom end of the side rod. The top rod and the bottom rod of a corresponding lower member are pivotally mounted on the first connecting seat. The second connecting seat is securely mounted on a top end of the side rod. A bottom end of the linking portion is connected to a corresponding one of the top rods. A top end of the linking portion extends through the side rod and is disposed at the second connecting seat. The upper supporting assembly is pivotally the side supporting assembly and has multiple arms. Each arm is pivotally mounted on a corresponding one of the second connecting seats and is connected to the top end of a corresponding linking portion.

The conventional foldable enclosure apparatus can be folded. In use, the moving seat of the hub member is pulled for driving the top rods of the lower members to rotate, and then the bottom rods of the lower members are rotated. Each side member is moved close to the hub member by the rotation of the top rods and the bottom rods of the lower members. The top rods drive the linking portions to fold the arms of the upper supporting assembly.

During the folding process, in each one of the lower members, the moving seat drives the top rod to rotate, and then the bottom rod is rotated with the top rod. Therefore, the rotation of the top rod does not conform to the rotation of the bottom rod of the lower member. As such, folding or spreading of the conventional foldable enclosure apparatus is not smooth and is unsteady.

To overcome the shortcomings, the present invention tends to provide a foldable enclosure apparatus for a baby bed to mitigate or obviate the aforementioned problems.

SUMMARY OF THE INVENTION

The main objective of the invention is to provide a foldable enclosure apparatus for a baby bed that can be easily, smoothly and steadily folded and spread.

The foldable enclosure apparatus for a baby bed has a hub device, a supporting assembly and four linking devices. The hub device has four racks. The supporting assembly is disposed around the hub device and has four side members and four upper members. The four side members are deposited around the hub device. The upper members are foldable and each upper member has two ends. Each end of the upper members is pivotally mounted on two adjacent side members. The linking devices are respectively mounted on the side members of the supporting assembly. Each linking device is connected with the hub device and the upper member is mounted on a corresponding one of the side members. Each linking device has a first linking assembly and a second linking assembly. Two ends of the first linking assembly are pivotally mounted on the hub device and the corresponding one of the side members respectively.

The first linking assembly has a gear portion, a rotating seat and a balance member. The gear portion is disposed at one of the ends of the first linking assembly which is connected to the hub device and engages with one of the racks of the hub device. The rotating seat is disposed at the other end of the first linking assembly which is connected to the side member and is rotatably mounted to a bottom end of the side member. The balance member is mounted in the first linking assembly. The second linking assembly is mounted on the corresponding one of the side members and has a bottom end and a top end. The bottom end is fixed on the rotating seat. The top end is pivotally mounted on the two upper members mounted on the corresponding one of the side members.

A user can pull the hub device, and then the racks are moved upwardly. The first linking assemblies and the side members are moved toward the hub device. In the meantime, the upper members are folded by the first linking assemblies and the second linking assemblies. The installment of the first linking assemblies and the second linking assemblies has the effects of linkage and balance. Therefore, the foldable enclosure apparatus for a baby bed can be easily, smoothly and steadily folded and spread.

Other objects, advantages and novel features of the invention will become more apparent from the following detailed description when taken in conjunction with the accompanying drawings.

DETAILED DESCRIPTION OF PREFERRED EMBODIMENT

Figure 1:
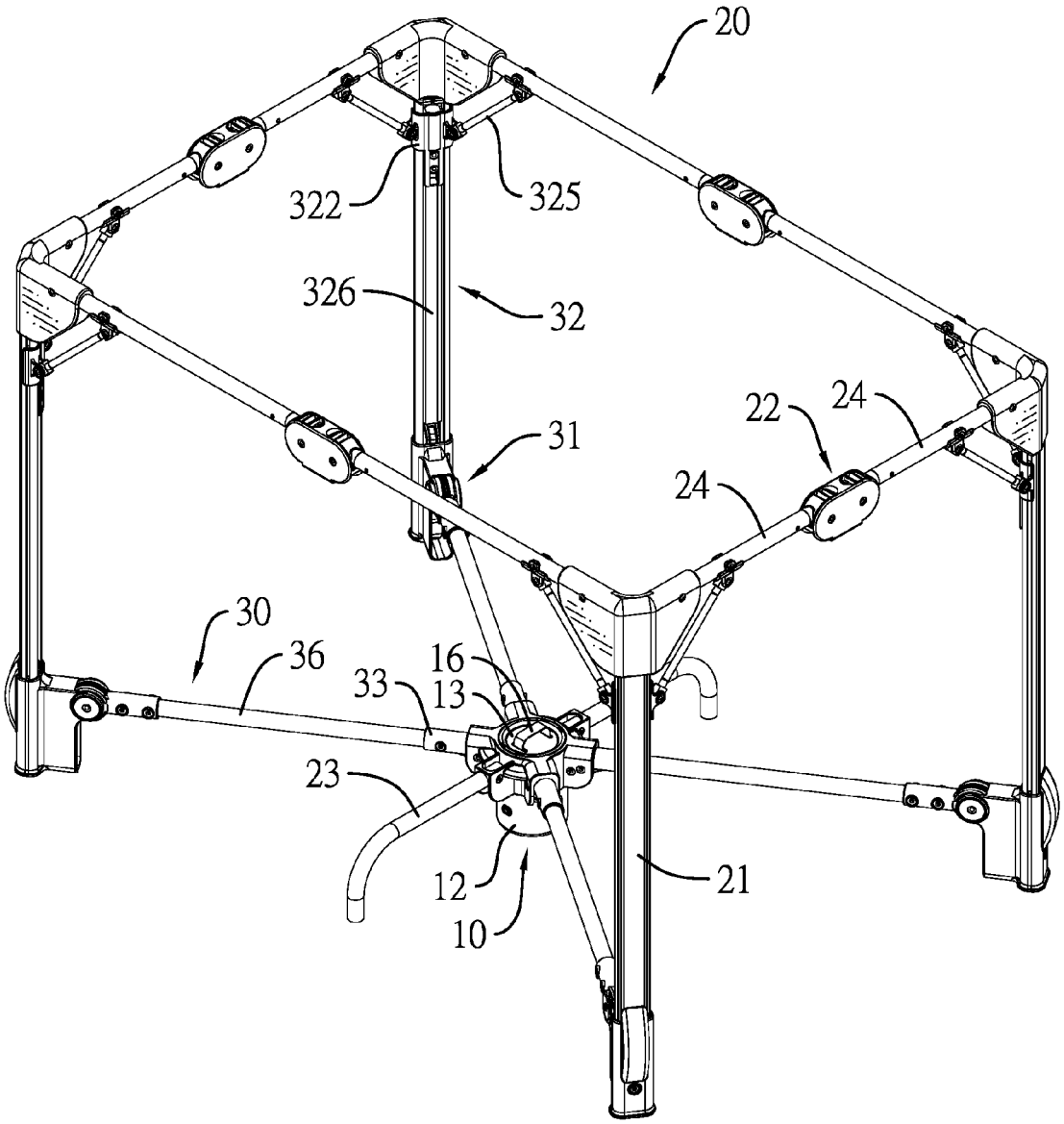
FIG. 1 is a perspective view of a foldable enclosure apparatus for a baby bed in accordance with the present invention.
Figure 3:
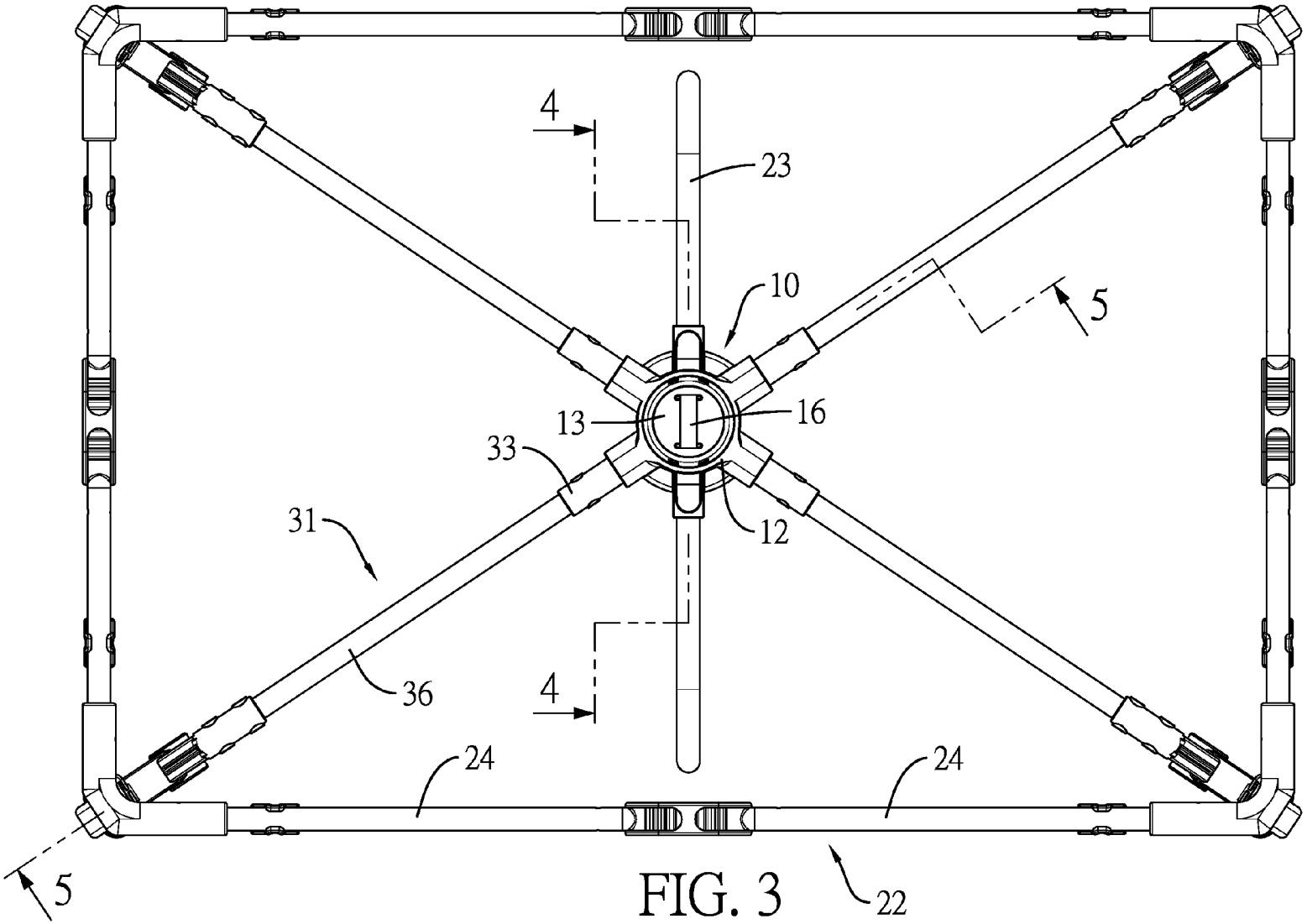
FIG. 3 is a top view of the foldable enclosure apparatus in FIG. 1.

With reference to FIGS. 1 and 3, a foldable enclosure apparatus for a baby bed in accordance with the present invention comprises a hub device 10, a supporting assembly 20, and four linking devices 30. The hub device 10 has four racks 11.

The supporting assembly 20 is disposed around the hub device 10 and has four side members 21, four upper members 22 being foldable, and two lower rods 23. The four side members 21 are deposited around the hub device 10. Each upper member 22 has two ends respectively and pivotally mounted on two adjacent side members 21. In addition, each upper member 22 has two upper rods 24 pivotally connected to each other and respectively connected to two adjacent side members 21. The lower rods 23 are pivotally mounted on the hub device 10.

Figure 2:
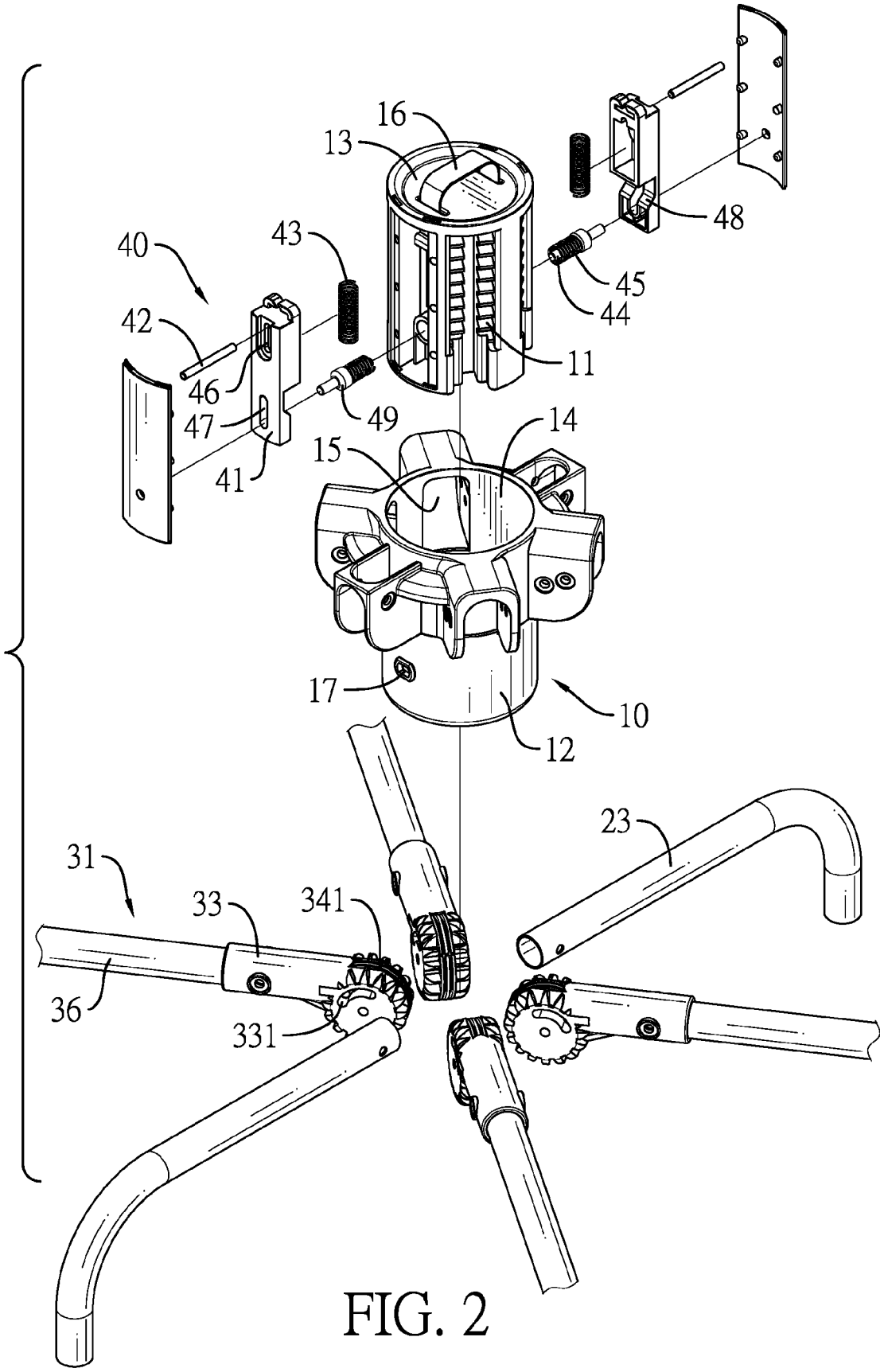
FIG. 2 is an enlarged exploded perspective view of the foldable enclosure apparatus in FIG. 1, showing a hub device.
Figure 5:
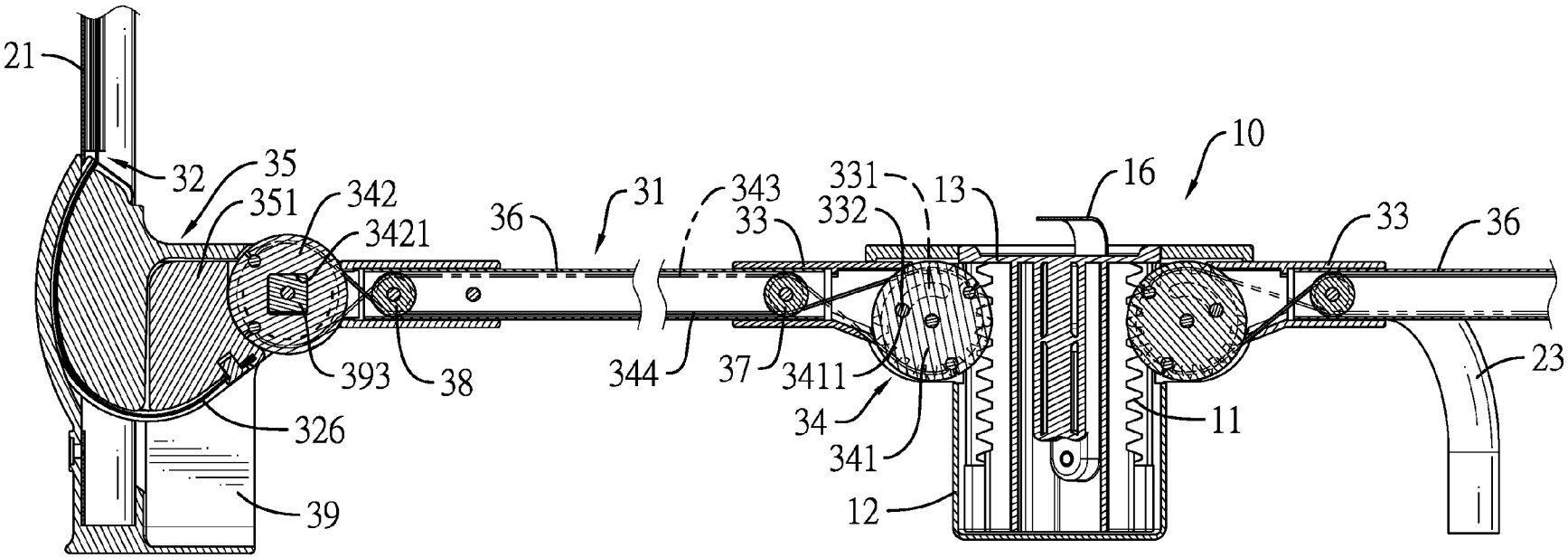
FIG. 5 is a cross sectional side view of the foldable enclosure apparatus along line 5-5 in FIG. 3.
Figure 6:
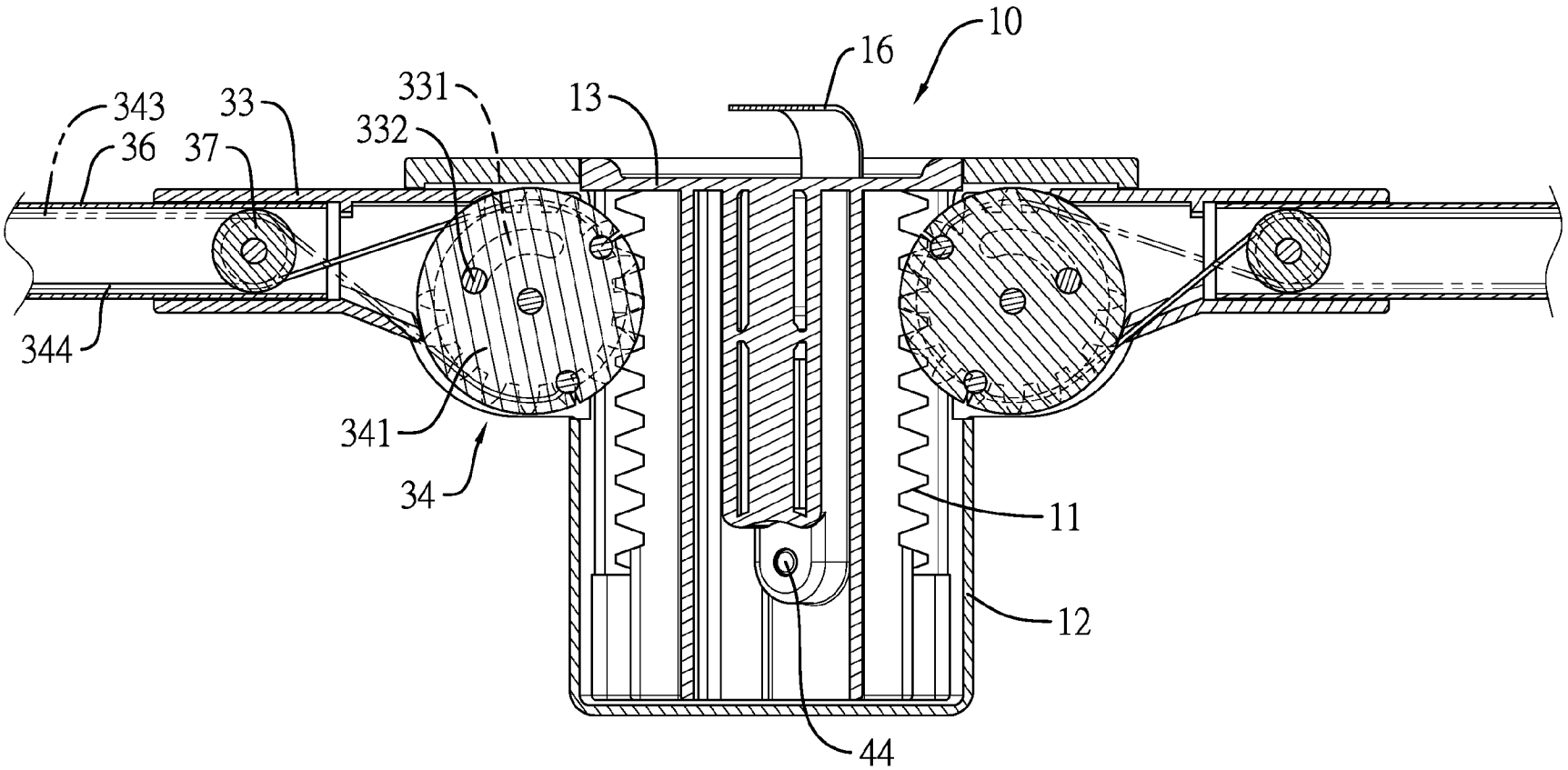
FIG. 6 is an enlarged cross sectional side view of the foldable enclosure apparatus in FIG. 5.

The linking devices 30 are respectively mounted on the side members 21 of the supporting assembly 20, each linking device 30 is connected with the hub device 10 and the upper member 22 mounted on a corresponding one of the side members 21. Each linking device 30 has a first linking assembly 31 and a second linking assembly 32. Two ends of the first linking assembly 31 are pivotally mounted on the hub device 10 and the corresponding one of the side members 21 respectively. With reference to FIGS. 2, 5 and 6, the first linking assembly 31 has a gear portion 33, a balance member 34, and a rotating seat 35. The gear portion 33 is disposed at one of the ends of the first linking assembly 31 that is close to the hub device 10 and engages with one of the racks 11 of the hub device 10. The balance member 34 is mounted in the first linking assembly 31. With reference to FIGS. 1 and 5, the rotating seat 35 is disposed at the other end of the first linking assembly 31 that is close to the side member 21 and is rotatably mounted to a bottom end of the corresponding side member 21.

With reference to FIG. 1, the second linking assembly 32 is mounted on the corresponding one of the side members 21. A bottom end of the second linking assembly 32 is fixed on the rotating seat 35. A top end of the second linking assembly 32 is pivotally mounted on the two upper members 22 mounted on the corresponding side member 21. The second linking assembly 32 co-acts with the rotating seat 35 mounted on the bottom end of the corresponding side member 21. When the rotating seat 35 is rotated, the bottom end of the second linking assembly 32 is pulled upwardly to fold the foldable enclosure apparatus, or the bottom end of the second linking assembly 32 is pushed downwardly to spread the foldable enclosure apparatus. The top end of the second linking assembly 32 is rotatably mounted on the corresponding one of the side members 22. The second linking assembly 32 can drive the upper member 22 to fold or to spread.

With reference to FIGS. 2, 5 and 6, the hub device 10 has a first seat 12 and a second seat 13. The first seat 12 has a chamber 14 and four notches 15. The chamber 14 is formed in the first seat 12. The notches 15 are formed on an outer surface of the first seat 12 and communicate with the chamber 14. The second seat 13 is moveably mounted in the first seat 12 and is disposed in the chamber 14. The second seat 13 has a handle 16 mounted on a top surface of the second seat 13. The racks 11 are mounted on an outer surface of the second seat 13 and respectively face the notches 15 of the first seat 12. The first linking assembly 31 is pivotally mounted on the first seat 12 of the hub device 10, and the gear portions 33 of the first linking assembly 31 are respectively inserted into the notches 15 and engage with the racks 11 respectively.

Figure 4:
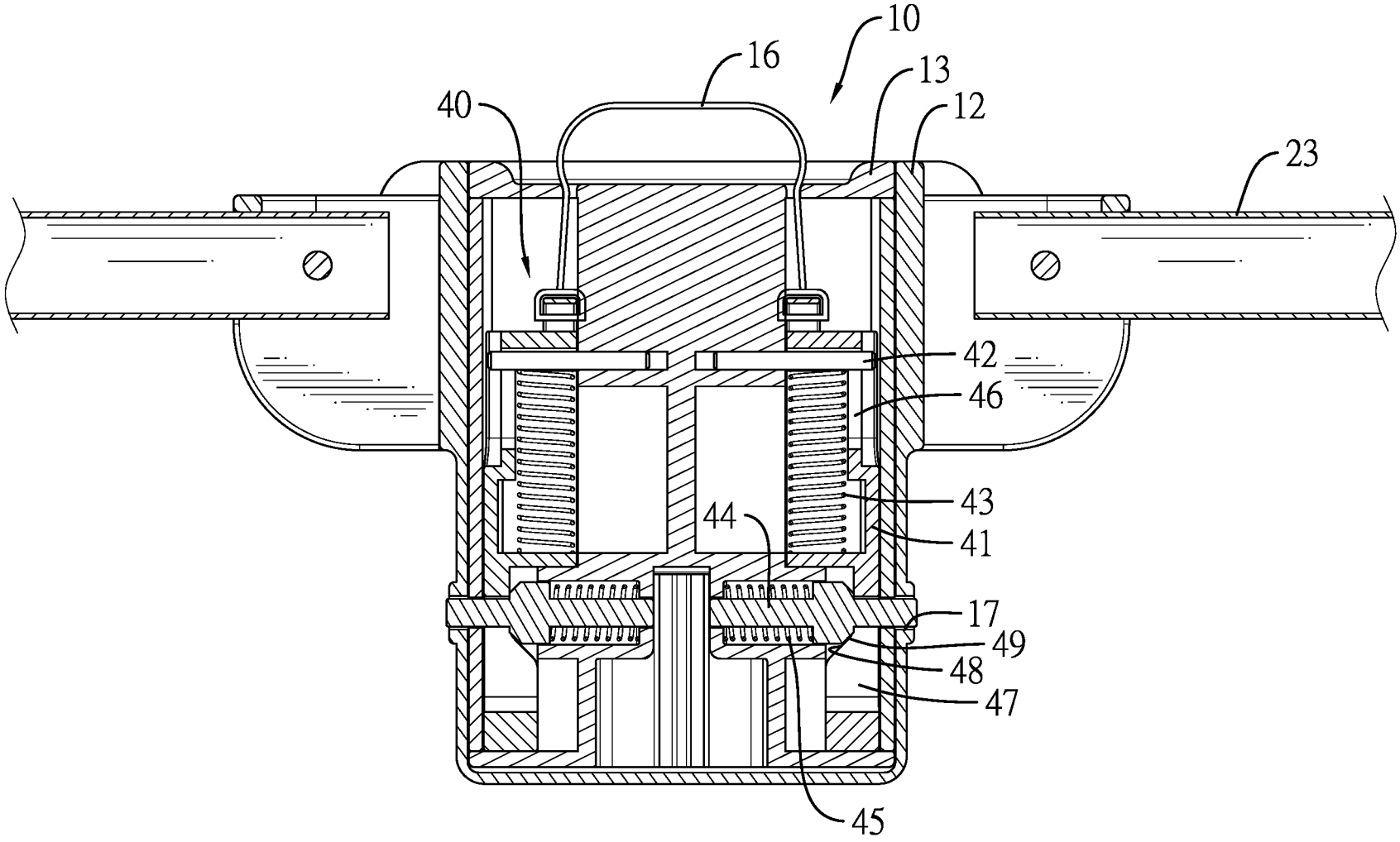
FIG. 4 is a cross sectional side view of the foldable enclosure apparatus along line 4-4 in FIG. 3.

With reference to FIGS. 2 and 4, the hub device 10 has two locating holes 17 and two restoring members 40. The locating holes 17 are formed on the outer surface of the first seat 12 and communicate with the chamber 14. The two restoring members 40 are mounted on the outer surface of the second seat 13 and are respectively connected to two ends of the handle 16. Each restoring member 40 has a restoring seat 41, a first positioning portion 42, a first restoring element 43, a second positioning portion 44, and a second restoring element 45. The restoring seat 41 is moveably mounted on the second seat 13 and has a first trough 46, a second trough 47, and a first inclined surface 48. The first trough 46 is formed on the restoring seat 41. The second trough 47 and the first inclined surface 48 are formed on the restoring seat 41 below the first trough 46. The first positioning portion 42 is fixed on the second seat 13 and is inserted into the first trough 46 of the restoring seat 41.

The first restoring element 43 is mounted in the restoring seat 41 and has two ends respectively connected to the restoring seat 41 and the first positioning portion 42. The second positioning portion 44 is moveably mounted on the second seat 13 and has an end and a second inclined surface 49. The end of the second positioning portion 44 is inserted through the second trough 47 and is inserted into a corresponding one of the locating holes 17 of the first seat 12. The second inclined surface 49 is formed on the second positioning portion 44 and abuts the first inclined surface 48 of the restoring seat 41. The second restoring element 45 is mounted around the second positioning portion 44 and has two ends respectively connected to the second positioning portion 44 and the second seat 13.

With reference to FIGS. 5 to 8, the foldable enclosure apparatus has four foot seats 39. The foot seats 39 are respectively mounted below the side members 21. Each balance member 34 has a first wheel 341, a second wheel 342, a first cable 343, and a second cable 344. The first wheel 341 is fixed on the hub device 10, is located in and is co-pivoted with a corresponding one of the gear portions 33. The second wheel 342 is fixed in one of the foot seats 39. The first cable 343 is connected to the first wheel 341 and the second wheel 342. The second cable 344 is connected to the first wheel 341 and the second wheel 342.

With reference to FIGS. 2 and 6, each gear portion 33 has a curved groove 331 and a retaining rod 332. The curved groove 331 is transversally formed through the gear portion 33, and the first wheel 341 is mounted in the gear portion 33 and has a retaining hole 3411. The retaining hole 3411 communicates with the curved groove 331. With reference to FIGS. 2 and 5, the retaining rod 332 is inserted through a hole which is formed on the hub device 10. The retaining rod 332 is further inserted through the curved groove 331 and the retaining hole 3411 to connect the gear portion 33 and the first wheel 341 securely with the hub device 10. A center of the first wheel 341 and the retaining rod 332 are defined as fixed points for fixing with the hub device 10. In addition, the curved groove 331 of the gear portions 33 provides a suitable rotation space to the gear portion 33.

With reference to FIG. 5, each first linking assembly 31 has a bottom rod 36 connected to the gear portion 33 and the rotating seat 35. Each balance member 34 has a first auxiliary wheel 37 and a second auxiliary wheel 38. The first auxiliary wheel 37 is mounted in a corresponding one of the bottom rods 36 and faces the first wheel 341. The second auxiliary wheel 38 is mounted in the corresponding bottom rod 36 and faces the second wheel 342. The first cable 343 passes through the first auxiliary wheel 37 and the second auxiliary wheel 38. The second cable 344 passes through the first auxiliary wheel 37 and the second auxiliary wheel 38.

Figure 7:
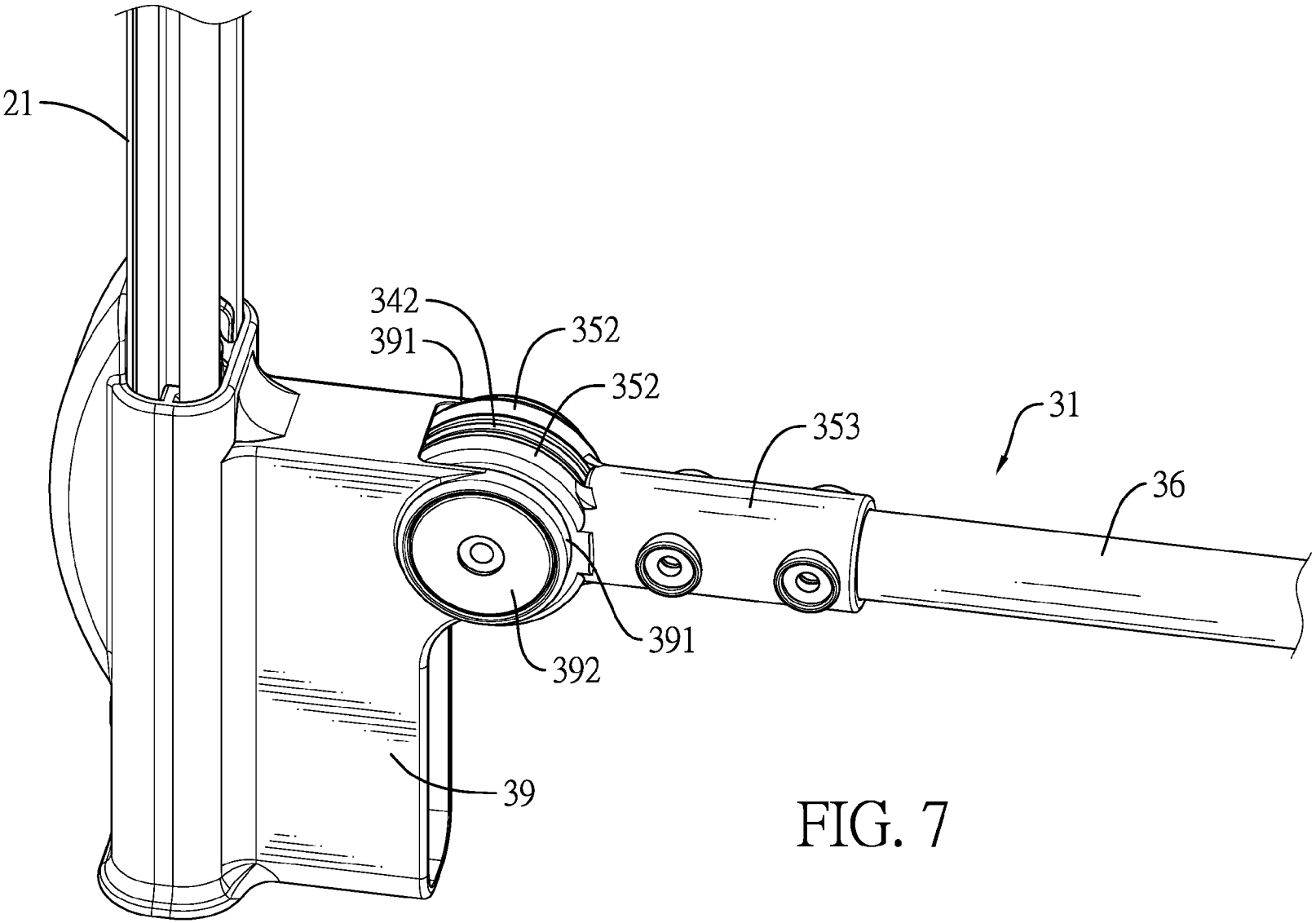
FIG. 7 is an enlarged perspective view of the foldable enclosure apparatus in FIG. 1.
Figure 8:
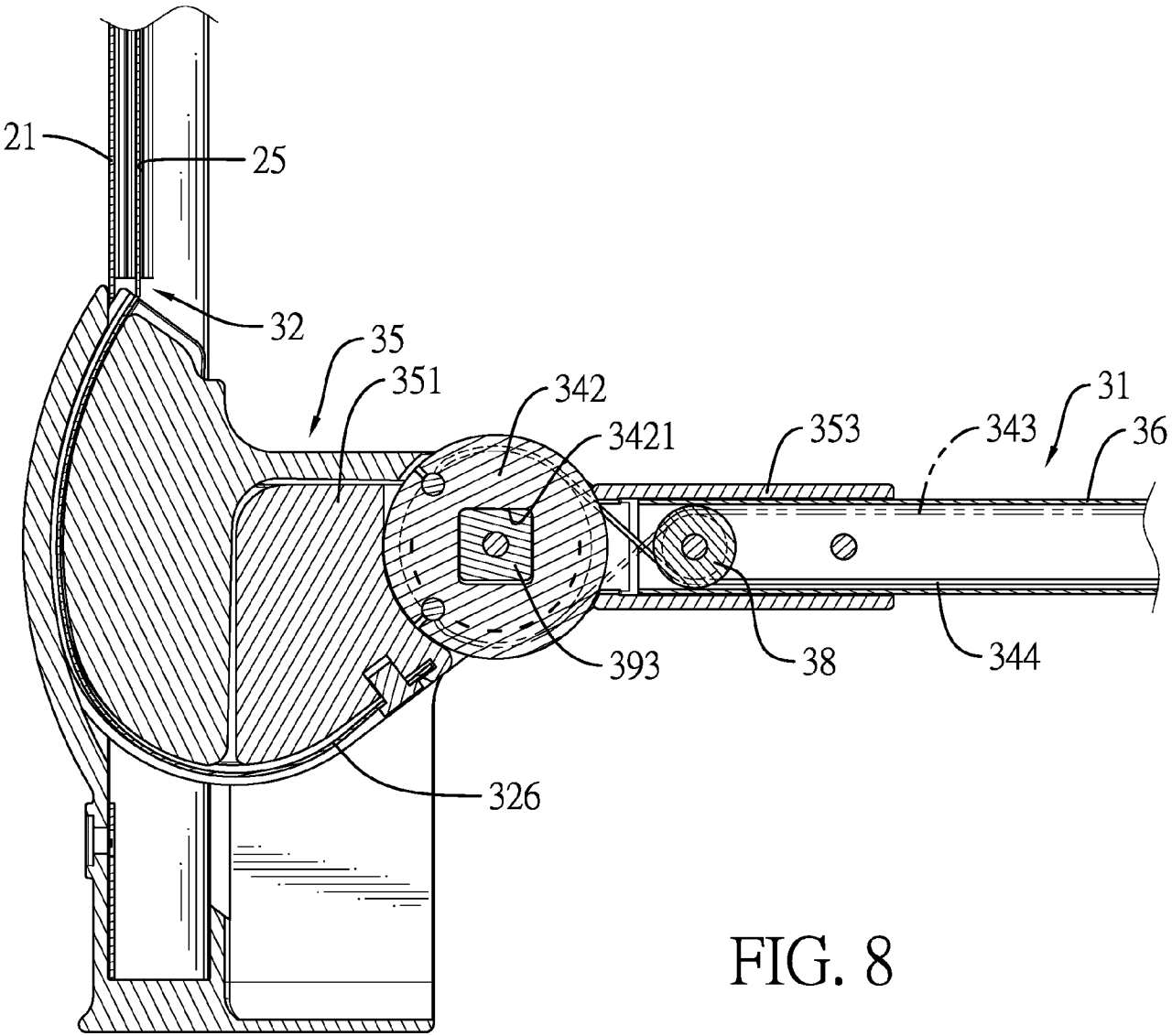
FIG. 8 is a cross sectional side view of the foldable enclosure apparatus in FIG. 7.

With reference to FIGS. 7 and 8, each rotating seat 35 is mounted in one of the foot seats 39 under a corresponding side member 21. Each foot seat 39 is connected to a corresponding bottom rod 36 and has two ring portions 391 and two square holes formed through the ring portions 391. The ring portions 391 are formed toward the corresponding bottom rod 36, and are parallel with each other at an interval. The two square holes are respectively formed through the two ring portions 391 and face each other.

Each rotating seat 35 has a body 351, two supporting portions 352, two circular holes formed through the supporting portions 352, and a connecting tube 353. The body 351 is mounted in the foot seat 39. The supporting portions 352 are formed on the body 351, face the ring portions 391 respectively, and are located between the two ring portions 39. The two circular holes are respectively formed through the two supporting portions 352 and face each other. The connecting tube 353 is formed on the supporting portions 352 toward a corresponding bottom rod 36 and is connected to the corresponding bottom rod 36. One of the second wheels 342 is located between the supporting portions 352 and has a square hole 3421. The square hole 3421 is formed through a center of the second wheel 342.

In addition, each foot seat 39 of the foldable enclosure apparatus has two covers 392. The two covers 392 are mounted on the foot seat 39 and are respectively inserted in the square holes of the two ring portions 391. Each cover 392 has a fixing rod. The fixing rod is formed on and protrudes from an inner surface of the cover 392 and has a square portion, a circular portion, and a square connector 393. The circular portion is connected to the square hole formed through the ring portion 391 and the square connector 393. The square portion is inserted into the square hole of the ring portion 391. The circular portion is inserted into the circular hole of the supporting portion 352. The square connector 393 is inserted into the square hole 3421 of the second wheel 342. With reference to FIG. 8, the second wheel 342 is fixed on the foot seat 39, and the rotating seat 35 is rotated relative to the fixing rods of the covers 392.

Figure 9:
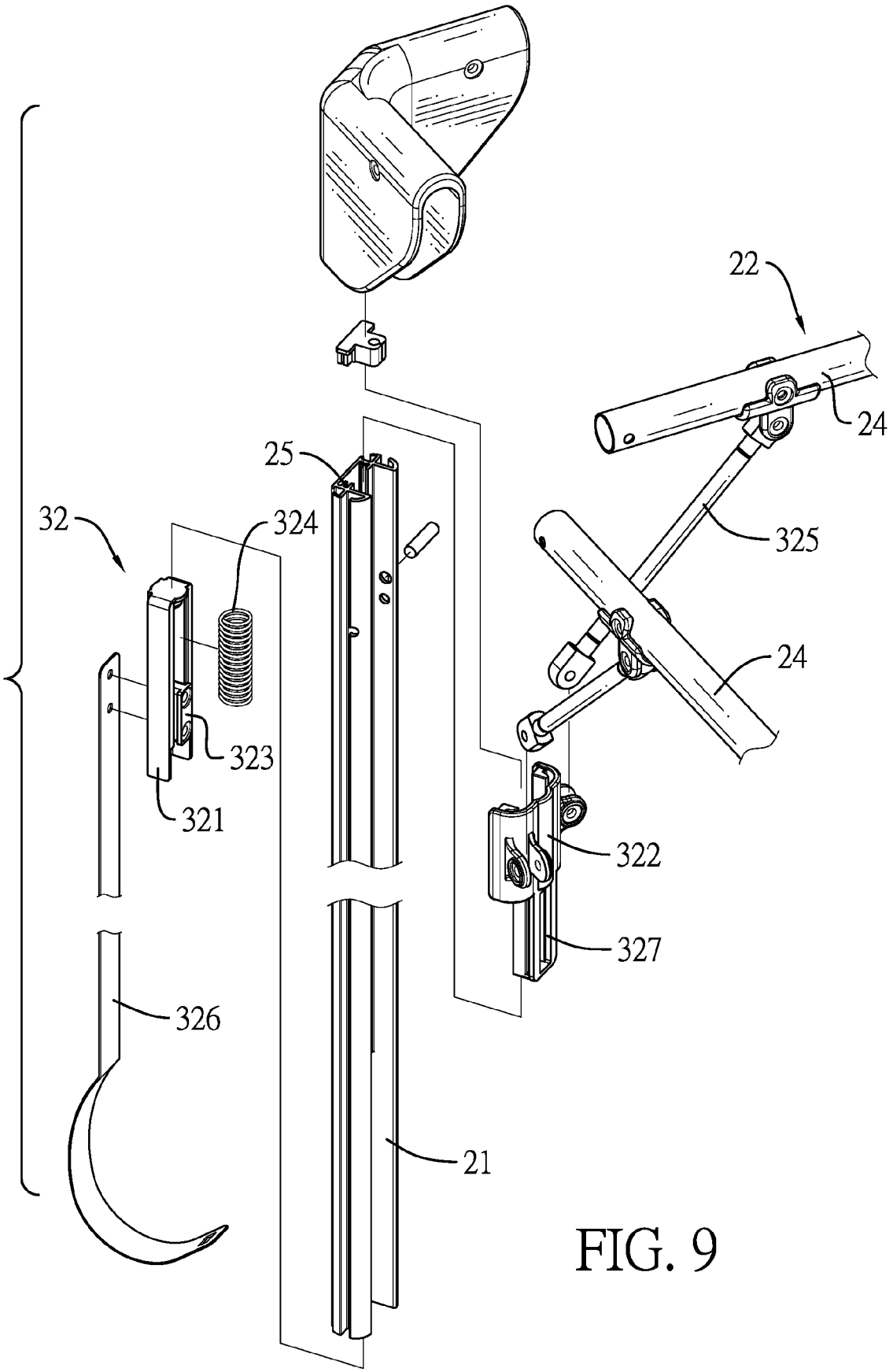
FIG. 9 is an enlarged exploded perspective view of a second linking assembly of the foldable enclosure apparatus in FIG. 1.
Figure 10:
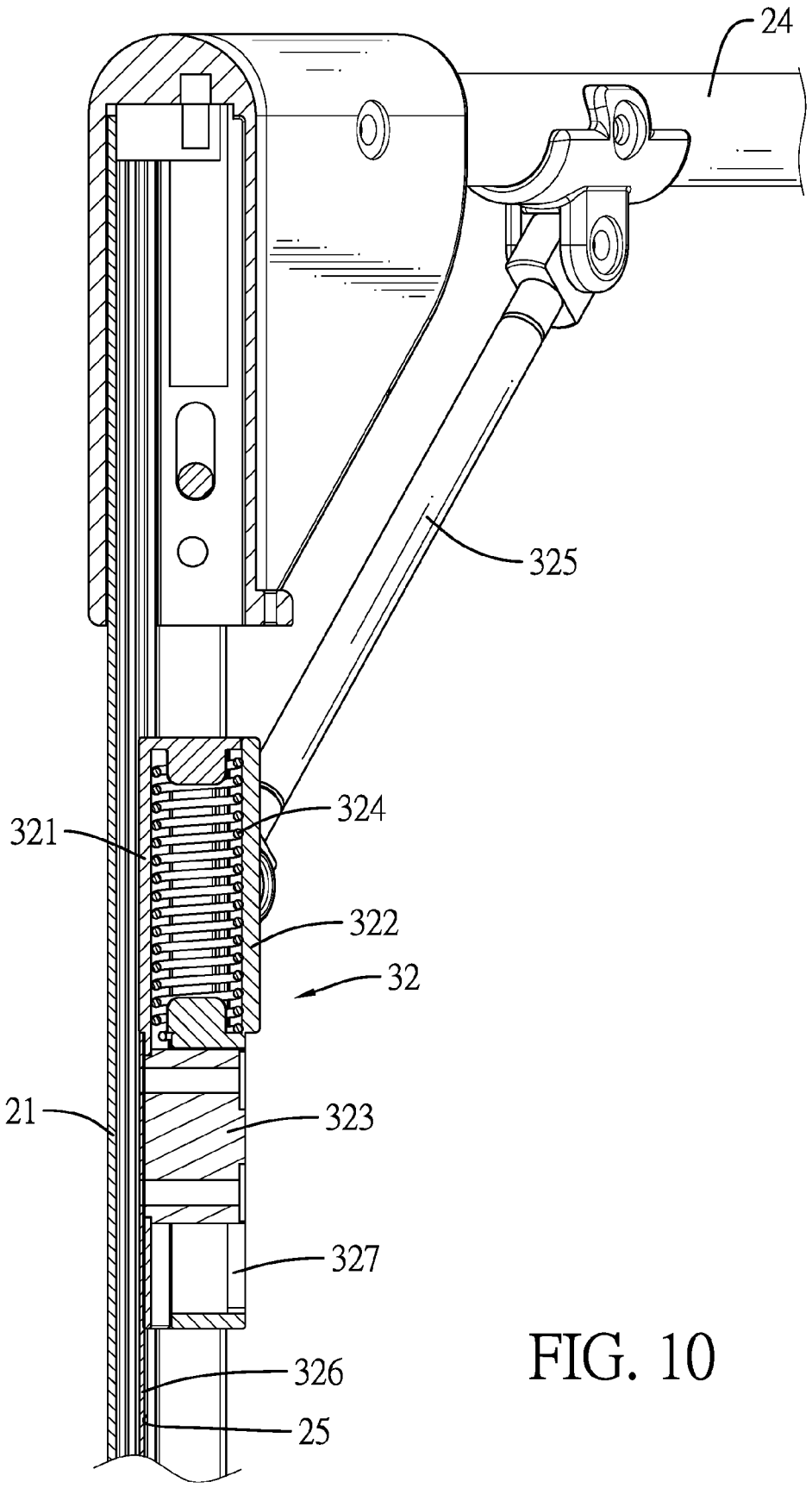
FIG. 10 is a side view in partial section of the second linking assembly of the foldable enclosure apparatus in FIG. 1.

With reference to FIGS. 9 and 10, each side member 21 further has a guide slot 25. The guide slot 25 is formed in the side member 21. Each second linking assembly 32 has a first moving seat 321, a second moving seat 322, a fixing block 323, a spring 324, two connecting rods 325, and a linking blade 326. The first moving seat 321 is moveably mounted on the side member 21. The second moving seat 322 is moveably mounted on the side member 21, is located outside the first moving seat 321, and has a moving groove 327. The fixing block 323 is fixedly mounted on the first moving seat 321 and is inserted into the moving groove 327. The spring 324 is mounted in the first moving seat 321 and is disposed above the fixing block 323.

The spring 324 has two ends respectively connected to the first moving seat 321 and the second moving seat 322. The connecting rods 325 are rotatably connected to the two upper members 22 mounted on the side member 21. The linking blade 326 is rigid and is inserted into the guide slot 25 of the side member 21. With reference to FIGS. 8 and 10, the linking blade 326 has two ends respectively fixed on the first moving seat 321 and a corresponding one of the rotating seats 35 of the first linking assemblies 31.

Figure 11:
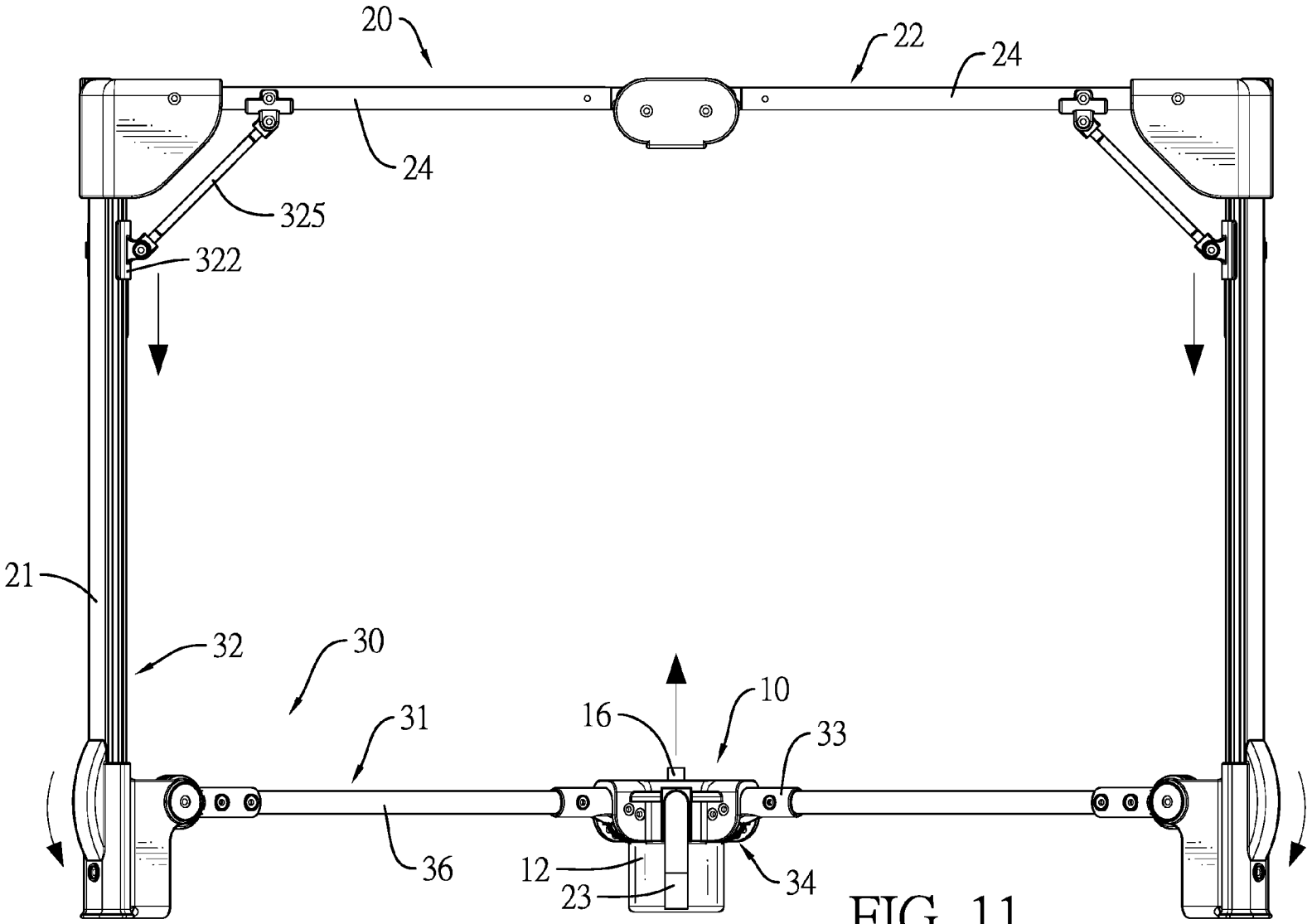
FIG. 11 is a front side view of the foldable enclosure apparatus in FIG. 1.
Figure 18:
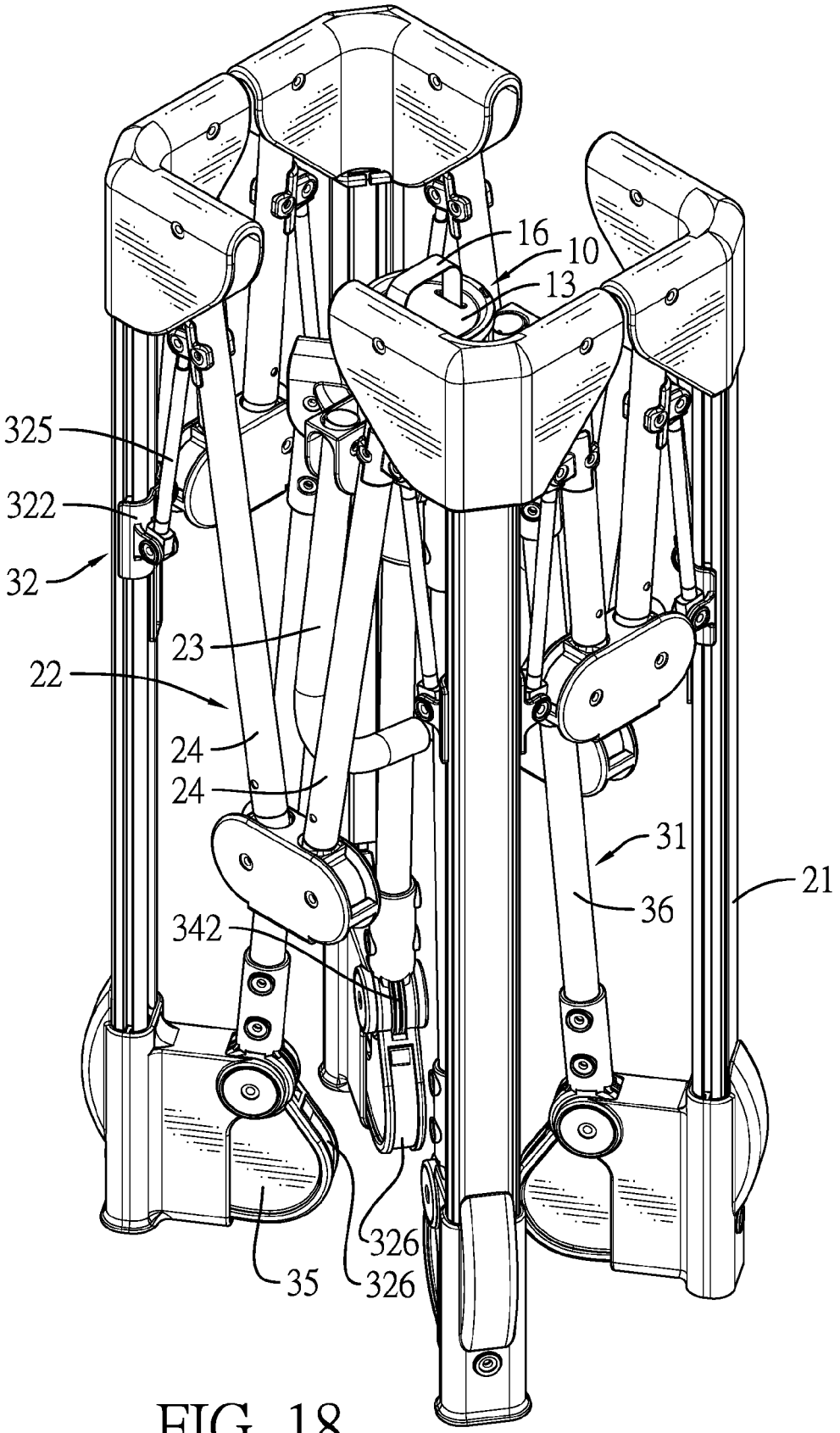
FIG. 18 is a perspective view of the foldable enclosure apparatus in FIG. 1, showing the foldable enclosure apparatus being folded.

With reference to FIGS. 11 and 18, when the foldable enclosure apparatus for a baby bed is folded, the hub device 10 is pulled upward. The first linking assemblies 31 and the side members 21 are driven by the hub device 10 to move toward the hub device 10. In the meantime, the upper members 22 are pulled by the first linking assemblies 31 and the second linking assemblies 32 to rotate and to be folded. Thus, the foldable enclosure apparatus for a baby bed can be folded quickly and conveniently. Moreover, the hub device 10 can be pushed downward and the bottom end of each second linking assembly 32 is pushed downward to spread the foldable enclosure apparatus for a baby bed.

Figure 12:
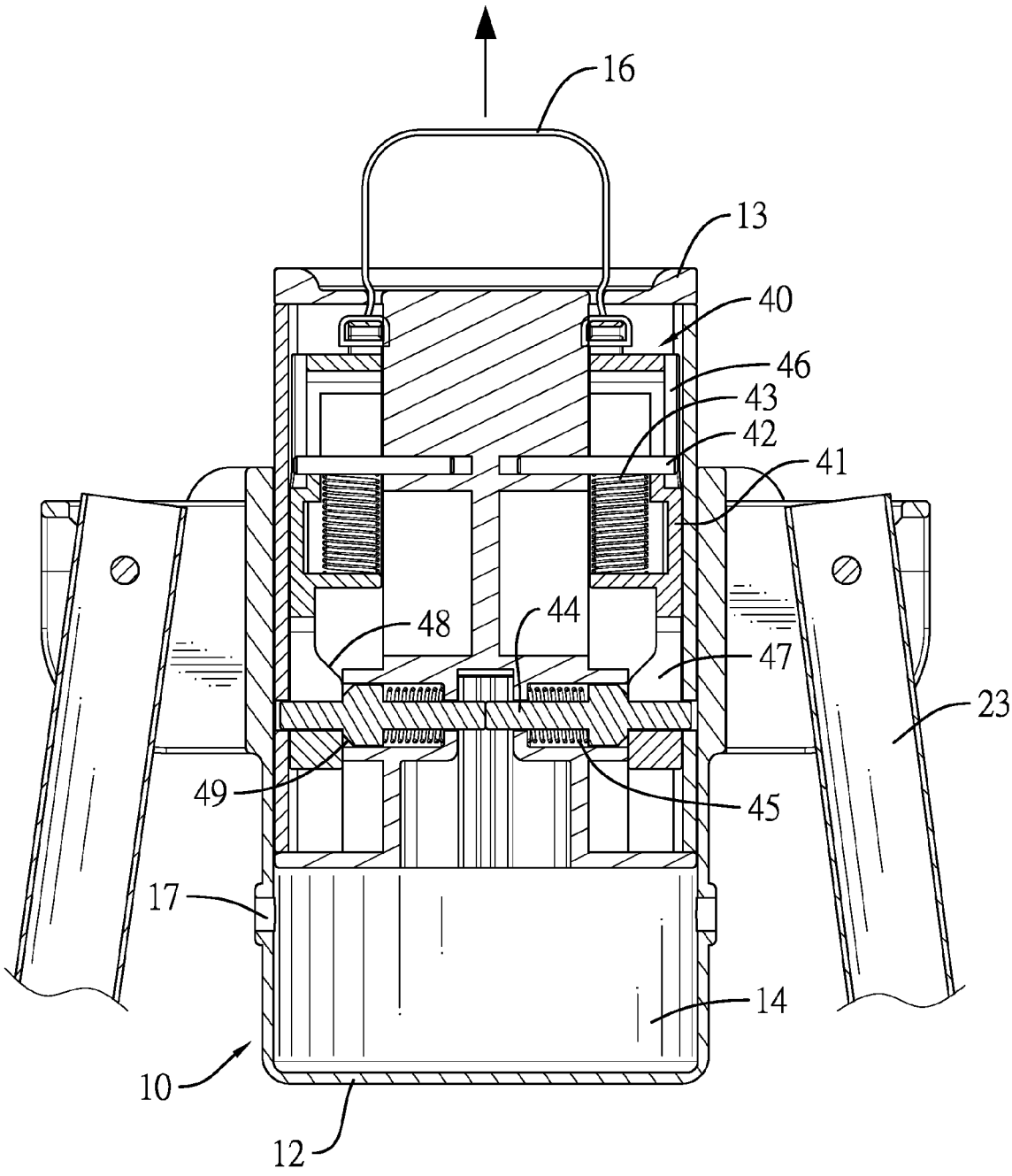
FIG. 12 is an enlarged and operational side view in cross section of the foldable enclosure apparatus in FIG. 1, showing the hub device moving.

With reference to FIG. 12, during the folding process of the foldable enclosure apparatus for a baby bed, the handle 16 of the hub device 10 is pulled upward for driving the restoring seats 41 of the restoring members 40 to move upward. In each restoring member 40, the first restoring element 43 is pressed. The first inclined surface 48 of the restoring seat 41 is pressed against the second inclined surface 49 of the second positioning portion 44. The second positioning portion 44 is moved out of the locating hole 17 of the first seat 12. The second seat 13 is pulled by the handle 16 and is moved upward relative to the first seat 12.

Figure 13:
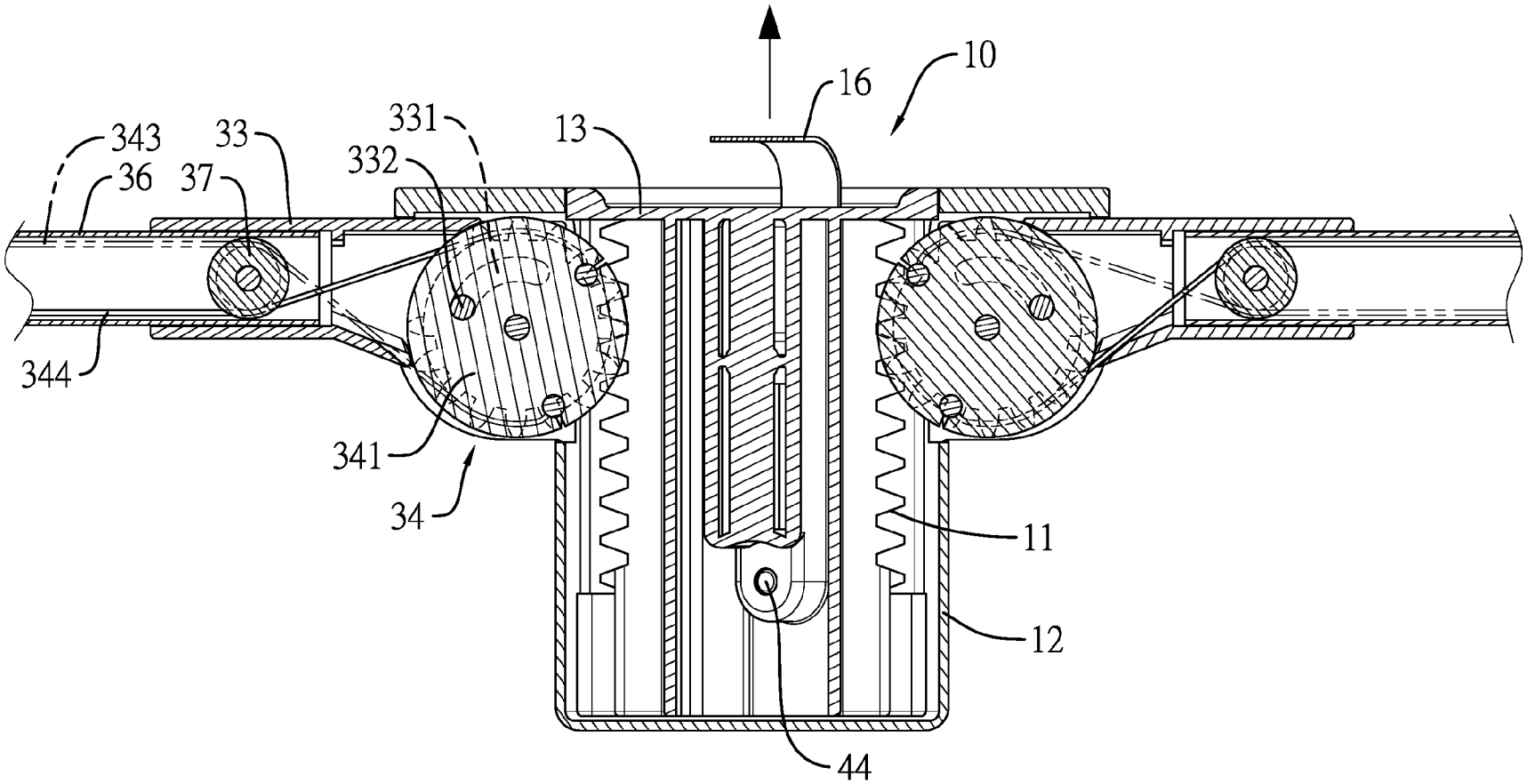
FIG. 13 is an enlarged and operational side view in cross section of the foldable enclosure apparatus in FIG. 1, showing a first linking assembly driven by the hub device.
Figure 14:
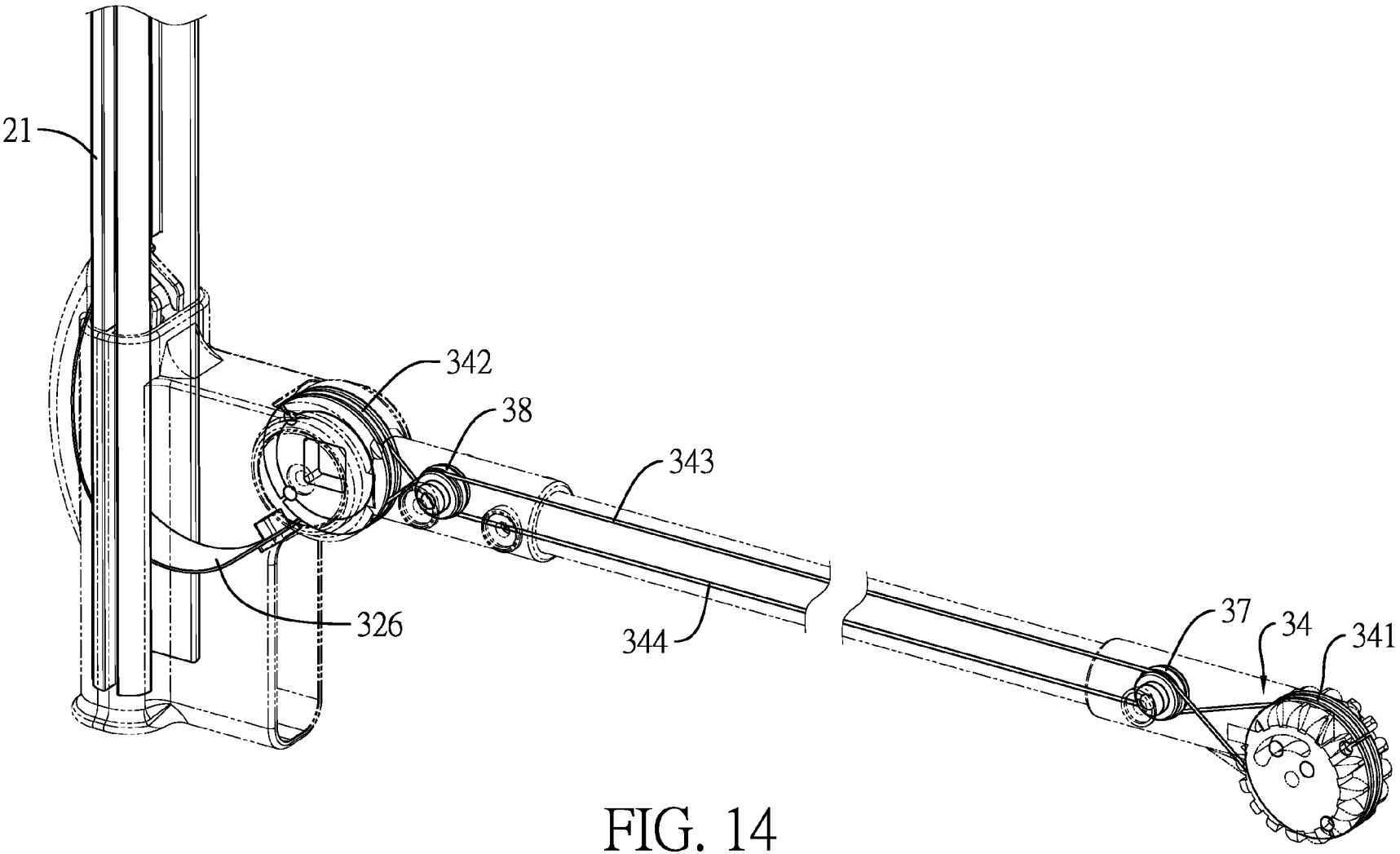
FIG. 14 is a perspective view of a balance member of the foldable enclosure apparatus in FIG. 1.
Figure 15:
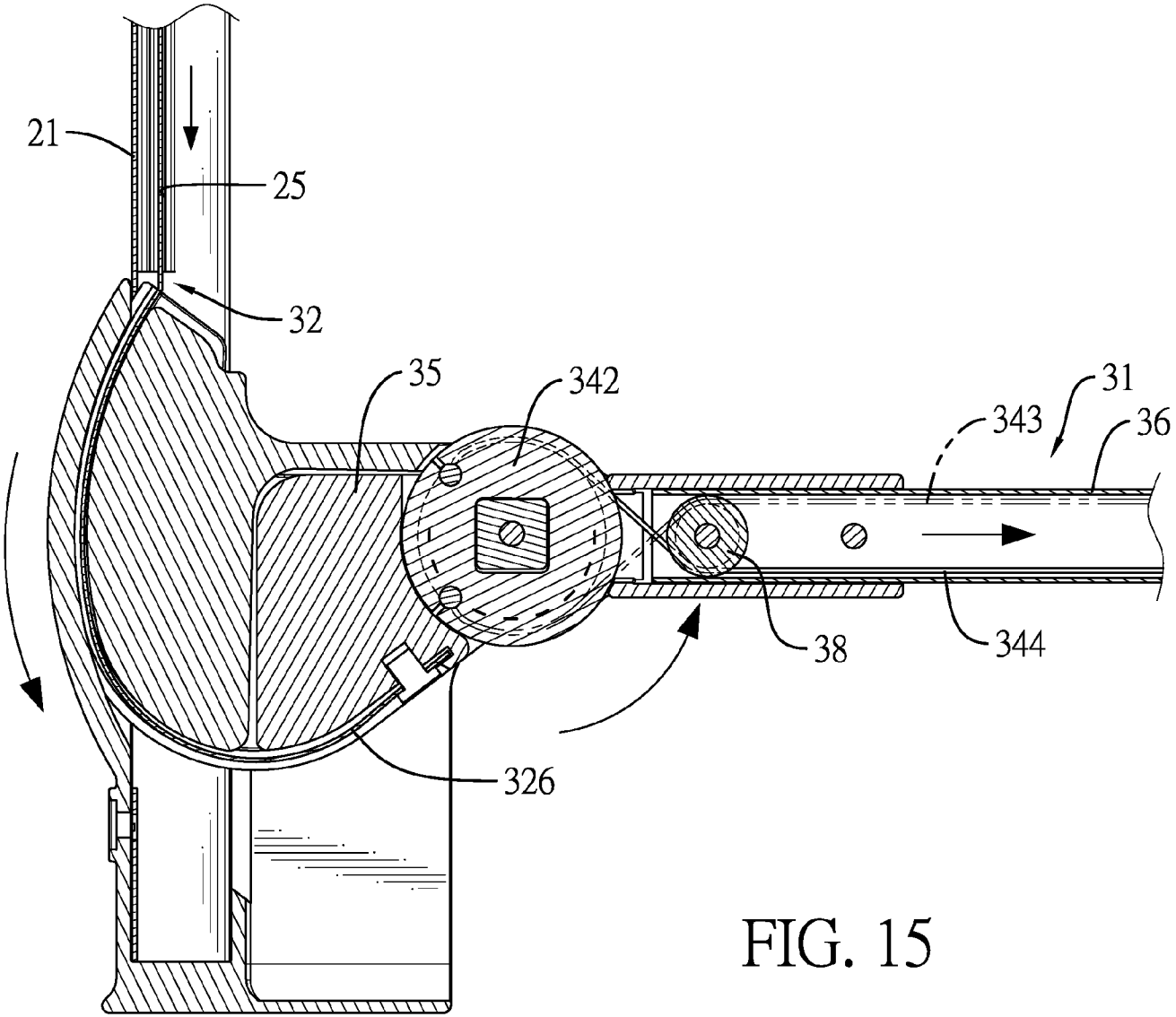
FIG. 15 is an enlarged and operational side view in cross section of the foldable enclosure apparatus in FIG. 1, showing the second linking assembly driven by the first linking assembly.

With reference to FIGS. 13 to 15, the second seat 13 is moved upward and the racks 11 of the second seat 13 are co-acted with the gear portions 33 of the first linking assemblies 31 that engage with the racks 11. The ends of the bottom rods 36 of the first linking assemblies 31 connected to the gear portions 33 are moved upward with the second seat 13. The other ends of the bottom rods 36 pull the side members 21 of the supporting assembly 20 to move toward the hub device 10.

Figure 16:
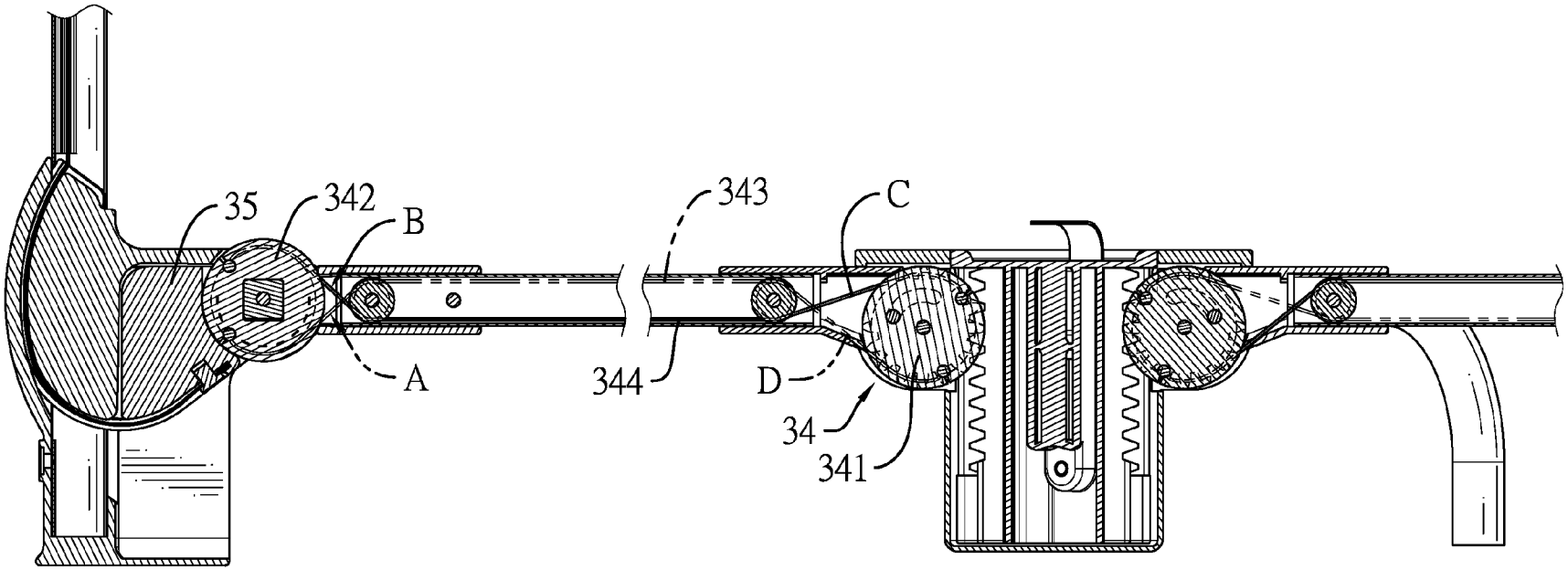
FIG. 16 is an operational side view in cross section of the foldable enclosure apparatus in FIG. 1, showing a motion of a first cable and a motion of a second cable.

With reference to FIGS. 13 to 15, the gear portions 33 of the first linking assemblies 31 are rotated by the racks 11 of the second seat 13 to move upward, and the rotating seats 35 are rotated by the bottom rods 36, and the bottom ends of the linking blades 326 are pulled upward. With reference to FIG. 16, each balance member 34 has a first section A, a second section B, a third section C, and a fourth section D. The first section A is formed on the first cable 343 between the second wheel 342 and the second auxiliary wheel 38. The second section B is formed on the second cable 344 between the second wheel 342 and the second auxiliary wheel 38. The second section B is above the first section A. The third section C is formed on the second cable 344 between the first wheel 341 and the first auxiliary wheel 37. The fourth section D is formed on the first cable 343 between the first wheel 341 and the first auxiliary wheel 37. The fourth section D is below the third section C. When the balance member 34 is operated, the first cable 343 in the first section A is mounted around the second wheel 342 in a counter-clockwise direction in a gradually tightened condition. The second cable 344 in the second section B is gradually dismounted from the second wheel 342 in a gradually loosened condition. At the same time, the second cable 344 in the third section C is in a gradually tightened condition, and the first cable 343 in the fourth section D is in a gradually loosened condition. For each balance member 34, the first cable 343 and the second cable 344 respectively generate a pulling force and a reverse force to form a balanced traction force. Therefore, the side members 21 are almost perpendicular to the ground during the folding process of the foldable enclosure apparatus.

Figure 17:
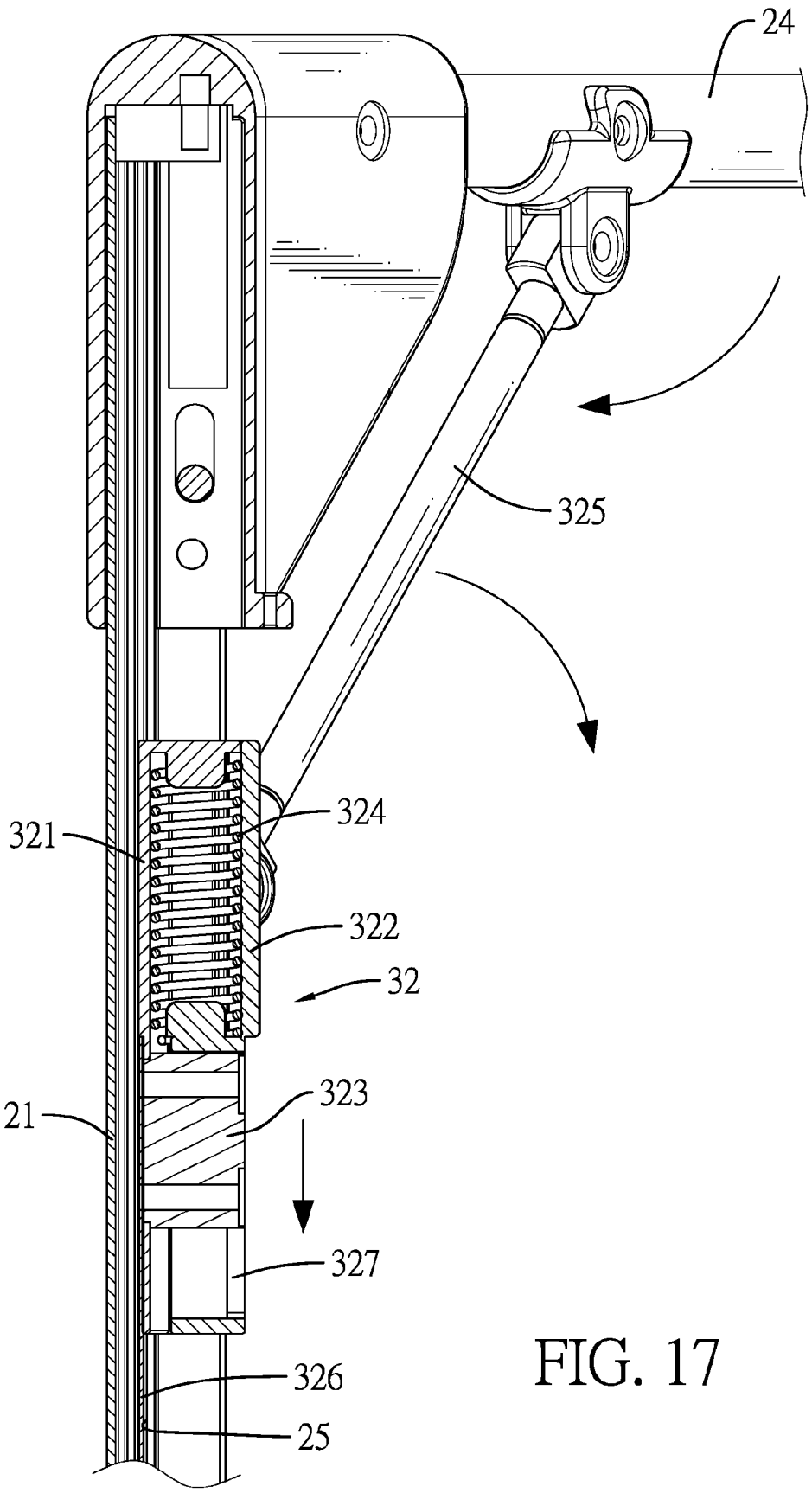
FIG. 17 is an enlarged and operational side view in partial section of the foldable enclosure apparatus in FIG. 1, showing an upper member driven by the second linking assembly.

With reference to FIG. 17, for each linking device 30, the first moving seat 321 and the fixing block 323 are pulled by the linking blade 326. The fixing block 323 is moved downward along the moving groove 327 of the second moving seat 322 to press the spring 324. The fixing block 323 is moved to a bottom end of the moving groove 327 and is still moved downward. The second moving seat 322 pushed by the fixing block 323 is moved downward. The two connecting rods 325 connected to the second moving seat 322 are pulled by the second moving seat 322 and then pull the upper members 22 which are connected to the two connecting rods 325. The upper rods 24 of the upper members 22 are rotated relative to the side members 21 for folding the foldable enclosure apparatus.

During the spreading process of the foldable enclosure apparatus for a baby bed, the handle 16 of the hub device 10 is pushed downward for spreading the first linking assemblies 31 and the side members 21. For each linking device 30, the gear portion 33 is rotated to drive the bottom rod 36 and the rotating seat 35 to rotate reversely. The linking blade 326 of the second linking device 32 is pushed downward by the bottom rod 36 and the rotating seat 35. The second wheel 342 is co-rotated with the rotating seat 35. The first wheel 341 is co-rotated with the gear portion 33. The first cable 343 and the second cable 344 are operated oppositely and respectively generate a pulling force and a reverse force to form the balanced traction force. The side members 21 are almost perpendicular to the ground by the balanced traction force in the spreading process. The first moving seat 321 is pushed upward by the linking blade 326 driven by the rotating seat 35 for spreading the upper members 22. In addition, the linking blade 326 is rigid and is good for supporting the upper member 22. The linking blade 326 is smoothly moved along the guide slot 25 of the side member 21.

Accordingly, the first linking assemblies 31 and the second linking assemblies 32 are simultaneously driven by the hub device 10 pulled upward to fold the side members 21 and the upper members 22. The first linking assemblies 31 and the second linking assemblies 32 are simultaneously driven by the hub device 10 pressed downward to spread the side members 21, and the linking blades 326 of the second linking assemblies 32 are simultaneously supported and spread the upper members 22. Therefore, the foldable enclosure apparatus for a baby bed can be easily, smoothly and steadily folded and spread.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A foldable enclosure apparatus for a baby bed, the foldable enclosure apparatus comprising:

a hub device having four racks;

a supporting assembly disposed around the hub device and having four side members deposited around the hub device; and four upper members being foldable, and each upper member having two ends and each end of each upper member pivotally mounted on one of two adjacent side members; and four linking devices, each linking device respectively mounted on one of the four side members of the supporting assembly, each linking device connected with the hub device and two upper members mounted on one of the side members, and each linking device comprising a first linking assembly and a second linking assembly;

the first linking assembly having two ends, each end of the first linking assembly is pivotally mounted on either the hub device or one of the side members, and the first linking assembly further comprising:

a gear portion disposed at one of the ends of the first linking assembly connected to the hub device and engaging with one of the racks of the hub device;

a rotating seat disposed at the other end of the first linking assembly connected to one of the side members and rotatably mounted to a bottom end of one of the side members; and a balance member mounted in an interior of the first linking assembly; and the second linking assembly mounted on one of the side members and the second linking assembly further comprising:

a lower end fixed on the rotating seat; and a top end pivotally mounted on the two upper members mounted on one of the side members; and wherein the foldable enclosure apparatus has four foot seats, each foot seat respectively mounted below one of the side members;

and each balance member has a first wheel fixed on the hub device and disposed in and co-pivoted with a corresponding one of the gear portions;

a second wheel fixed in one of the foot seats;

a first cable connected to the first wheel and the second wheel;

and a second cable connected to the first wheel and the second wheel.

2. The foldable enclosure apparatus for the baby bed as claimed in claim 1, wherein the hub device has a first seat having comprising:

a chamber formed in the first seat; and four notches formed on an outer surface of the first seat and communicating with the chamber; and a second seat moveably mounted in the first seat and disposed in the chamber, and the second seat having a handle mounted on a top surface of the second seat; and the racks mounted on an outer surface of the second seat and each rack respectively facing one of the four notches of the first seat; and each first linking assembly is pivotally mounted on the first seat of the hub device, and the gear portion of each first linking assembly is respectively inserted into the notches and engage with the racks respectively.

3. The foldable enclosure apparatus for the baby bed as claimed in claim 2, wherein the hub device has two locating holes formed on the outer surface of the first seat and communicating with the chamber and two restoring members mounted on the outer surface of the second seat and respectively connected to two ends of the handle, and each restoring member comprising:

a restoring seat moveably mounted on the second seat and a first trough formed on the restoring seat; a second trough formed on the restoring seat below the first trough; and a first inclined surface formed on the restoring seat below the first trough; a first positioning portion fixed on the second seat and inserted into the first trough of the restoring seat; a first restoring element mounted in the restoring seat and having two ends respectively connected to the restoring seat and the first positioning portion; a second positioning portion moveably mounted on the second seat and having an end inserted through the second trough and inserted into a corresponding one of the locating holes of the first seat; and a second inclined surface formed on the second positioning portion and abutting the first inclined surface of the restoring seat; and a second restoring element mounted around the second positioning portion and having two ends respectively connected to the second positioning portion and the second seat.

4. The foldable enclosure apparatus for the baby bed as claimed in claim

3, wherein each gear portion has a curved groove transversally formed through a surface of the gear portion and a retaining rod fixed in the hub device and inserted through the curved groove and a corresponding one of the first wheels.

5. The foldable enclosure apparatus for the baby bed as claimed in claim 4, wherein each first linking assembly has a bottom rod connected to the gear portion and the rotating seat.

6. The foldable enclosure apparatus for the baby bed as claimed in claim 5, wherein each balance member has a first auxiliary wheel mounted in a corresponding one of the bottom rods and facing the first wheel;

a second auxiliary wheel mounted in the corresponding one of the bottom rods and facing the second wheel;

the first cable passing through the first auxiliary wheel and the second auxiliary wheel; and the second cable passing through the first auxiliary wheel and the second auxiliary wheel.

7. The foldable enclosure apparatus for the baby bed as claimed in claim 6, wherein each side member has a guide slot formed in a surface of the side member; and each second linking assembly comprising: a first moving seat moveably mounted on one of the side members, a second moving seat moveably mounted on one of the side members, located outside the first moving seat, and having a moving groove, a fixing block mounted on the first moving seat and inserted into the moving groove, a spring mounted in the first moving seat and located above the fixing block and respectively connected to the first moving seat and the second moving seat;

two connecting rods rotatably connected to the two upper members mounted on one of the side members, and a linking blade being rigid and inserted into the guide slot of one of the side members, and two ends of the linking blade respectively fixed on the first moving seat and a corresponding one of the rotating seats of the first linking assemblies.

8. The foldable enclosure apparatus for the baby bed as claimed in claim 3, wherein each side member has a guide slot formed in a surface of the side member; and each second linking assembly comprising: a first moving seat moveably mounted on one of the side members, a second moving seat moveably mounted on one of the side members, located outside the first moving seat, and having a moving groove, a fixing block mounted on the first moving seat and inserted into the moving groove, a spring mounted in the first moving seat and located above the fixing block and respectively connected to the first moving seat and the second moving seat;

two connecting rods rotatably connected to the two upper members mounted on one of the side members, and a linking blade being rigid and inserted into the guide slot of one of the side members, and two ends of the linking blade respectively fixed on the first moving seat and a corresponding one of the rotating seats of the first linking assemblies.

9. The foldable enclosure apparatus for the baby bed as claimed in claim

2, wherein each gear portion has a curved groove transversally formed through a surface of the gear portion and a retaining rod fixed in the hub device and inserted through the curved groove and a corresponding one of the first wheels.

10. The foldable enclosure apparatus for the baby bed as claimed in claim 9, wherein each first linking assembly has a bottom rod connected to the gear portion and the rotating seat.

11. The foldable enclosure apparatus for the baby bed as claimed in claim 10, wherein each balance member has a first auxiliary wheel mounted in a corresponding one of the bottom rods and facing the first wheel;

a second auxiliary wheel mounted in the corresponding one of the bottom rods and facing the second wheel;

the first cable passing through the first auxiliary wheel and the second auxiliary wheel; and the second cable passing through the first auxiliary wheel and the second auxiliary wheel.

12. The foldable enclosure apparatus for the baby bed as claimed in claim 2, wherein each side member has a guide slot formed in a surface of the side member; and each second linking assembly comprising: a first moving seat moveably mounted on one of the side members, a second moving seat moveably mounted on one of the side members, located outside the first moving seat, and having a moving groove, a fixing block mounted on the first moving seat and inserted into the moving groove, a spring mounted in the first moving seat and located above the fixing block and respectively connected to the first moving seat and the second moving seat;

two connecting rods rotatably connected to the two upper members mounted on one of the side members, and a linking blade being rigid and inserted into the guide slot of one of the side members, and two ends of the linking blade respectively fixed on the first moving seat and a corresponding one of the rotating seats of the first linking assemblies.

13. The foldable enclosure apparatus for the baby bed as claimed in claim

1, wherein each gear portion has a curved groove transversally formed through a surface of the gear portion and a retaining rod fixed in the hub device and inserted through the curved groove and a corresponding one of the first wheels.

14. The foldable enclosure apparatus for the baby bed as claimed in claim 13, wherein each first linking assembly has a bottom rod connected to the gear portion and the rotating seat.

15. The foldable enclosure apparatus for the baby bed as claimed in claim 14, wherein each balance member has a first auxiliary wheel mounted in a corresponding one of the bottom rods and facing the first wheel;

a second auxiliary wheel mounted in the corresponding one of the bottom rods and facing the second wheel;

the first cable passing through the first auxiliary wheel and the second auxiliary wheel; and the second cable passing through the first auxiliary wheel and the second auxiliary wheel.

16. The foldable enclosure apparatus for the baby bed as claimed in claim 15, wherein each side member has a guide slot formed in a surface of the side member; and each second linking assembly comprising: a first moving seat moveably mounted on one of the side members, a second moving seat moveably mounted on one of the side members, located outside the first moving seat, and having a moving groove, a fixing block mounted on the first moving seat and inserted into the moving groove, a spring mounted in the first moving seat and located above the fixing block and respectively connected to the first moving seat and the second moving seat;

two connecting rods rotatably connected to the two upper members mounted on one of the side members, and a linking blade being rigid and inserted into the guide slot of one of the side members, and two ends of the linking blade respectively fixed on the first moving seat and a corresponding one of the rotating seats of the first linking assemblies.

17. The foldable enclosure apparatus for the baby bed as claimed in claim 1, wherein each side member has a guide slot formed in a surface of the side member; and each second linking assembly comprising: a first moving seat moveably mounted on one of the side members, a second moving seat moveably mounted on one of the side members, located outside the first moving seat, and having a moving groove, a fixing block mounted on the first moving seat and inserted into the moving groove, a spring mounted in the first moving seat and located above the fixing block and respectively connected to the first moving seat and the second moving seat;

two connecting rods rotatably connected to the two upper members mounted on one of the side members, and a linking blade being rigid and inserted into the guide slot of one of the side members, and two ends of the linking blade respectively fixed on the first moving seat and a corresponding one of the rotating seats of the first linking assemblies.

* * * * *